US008055178B2

(12) United States Patent
Shono et al.

(10) Patent No.: US 8,055,178 B2
(45) Date of Patent: Nov. 8, 2011

(54) CLEANING DEVICE, PROCESS CARTRIDGE, AND IMAGE FORMING APPARATUS HAVING A PRESSING MEMBER WHICH CONTACTS AN ELASTIC BLADE

(75) Inventors: Hidekazu Shono, Hyogo (JP); Naoki Nakatake, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 448 days.

(21) Appl. No.: 12/062,951

(22) Filed: Apr. 4, 2008

(65) Prior Publication Data

US 2008/0310896 A1 Dec. 18, 2008

(30) Foreign Application Priority Data

Jun. 18, 2007 (JP) ..... 2007-159714

(51) Int. Cl.
*G03G 21/00* (2006.01)

(52) U.S. Cl. ..... 399/350

(58) Field of Classification Search ..... 399/345, 399/350, 351

See application file for complete search history.

(56) References Cited

U.S. PATENT DOCUMENTS 4,577,955 A * 3/1986 Mayer et al. ..... 399/345
4,702,591 A * 10/1987 Tsuda et al. ..... 399/345
4,969,015 A * 11/1990 Sanpe ..... 399/345
5,379,100 A * 1/1995 Kudo et al. ..... 399/351
2007/0009293 A1* 1/2007 Akiba et al. ..... 399/350

FOREIGN PATENT DOCUMENTS

JP 03044664 A * 2/1991
JP 03091789 A * 4/1991
JP 03243977 A * 10/1991
JP 08006451 A * 1/1996
JP 2005315946 A * 11/2005
JP 2006-243411 9/2006

* cited by examiner

*Primary Examiner* — David Gray
*Assistant Examiner* — Billy J Lactaoen
(74) *Attorney, Agent, or Firm* — Oblon, Spivak, McClelland, Maier & Neustadt, L.L.P.

(57) ABSTRACT

A cleaning device capable of reducing the apparatus and prolonging the service life of the cleaning blade is disclosed. The cleaning device includes a cleaning blade including an elastic blade, a pressing member disposed near the downstream side of the image carrier with respect to the elastic blade, and a driving mechanism for driving the pressing member so as to be in contact with and press the elastic blade. The driving mechanism operates so as to press the elastic blade in the upstream direction to separate the elastic blade from the surface of the image carrier for a while. Then, the driving mechanism operates to move the pressing member to be separated from the elastic blade so that the elastic blade is in contact with the surface of the image carrier.

13 Claims, 14 Drawing Sheets

CLEANING DEVICE, PROCESS CARTRIDGE, AND IMAGE FORMING APPARATUS HAVING A PRESSING MEMBER WHICH CONTACTS AN ELASTIC BLADE

BACKGROUND OF THE INVENTION

1. Field of the Invention

The present invention generally relates to a cleaning device, a process cartridge, and an image forming apparatus, and more specifically to a cleaning device, a process cartridge, and an image forming apparatus having an electrophotographic process unit.

2. Description of the Related Art

The electrophotographic process performed in an image forming apparatus generally includes charging, exposing, developing, transferring, fixing, and cleaning. In the cleaning process performed as a final process, a blade cleaning method is usually used.

Some full-color image forming apparatuses employ the blade cleaning method. Such full-color image forming apparatus includes developing devices for developing yellow (Y), magenta (M), cyan (C), and black (Bk) images, respectively. Each developing device includes a photosensitive drum serving as an image carrier capable of being rotatably driven, and the surface of the photosensitive drum is uniformly charged by a charging device. Then, a laser beam is irradiated onto the surface by an optical system for exposure so that the surface of the photosensitive drum is exposed to form an electrostatic latent image on the surface of the photosensitive drum. Then, a developing agent in the developing unit is applied to the surface of the photosensitive drum so that a visible image is formed on the photosensitive drum.

The image forming apparatus further includes an intermediate transferring device, and the formed visible image is transferred in a contacting section between the intermediate transferring device and the photosensitive drum. More specifically, the formed visible image on the surface of the photosensitive drum is transferred onto a surface of a transfer belt by a transferring roller in the intermediate transferring device. The transferred developing agent forming the visible toner image is transferred onto a sheet serving as an image carrier in a secondary transferring section. Then, the sheet is fed into a fixing device, where the toner image is fixed on the sheet. On the other hand, the developing agent remaining on the surface of the photosensitive drum is cleaned and removed by a cleaning blade in a cleaning device. An image forming apparatus having the above configuration is described in Patent Document 1 (Japanese Patent Application Publication No. 2006-243411).

The cleaning blade accommodated in a developing device has a plate shape and is made of an elastic member of such material as polyurethane. The cleaning blade is fixed to a supporting body and is pressed to and in contact with a surface of the rotating photosensitive body. Generally, there are two types of developing units.

FIG. 13 is a cut-open view schematically showing a first type of the developing unit. As shown in FIG. 13, in this developing device 4, a head of a cleaning blade 11*a* of a cleaning device 11 is in contact with a photosensitive drum 1. The cleaning blade 11*a* is directly fixed to a chassis 4*j* of the developing device 4 with a bolt so that the cleaning blade 11*a* is pressed to and in contact with the photosensitive drum 1 with a prescribed contacting pressure. This contacting pressure is produced by a restoration force due to elastic deformation of the cleaning blade 11*a*, the restoration force being used as a blade pressing force applied to the photosensitive drum 1.

FIG. 14 is a cut-open view schematically showing a second type of the developing unit. As shown in FIG. 14, in the developing device 4, a pressure promoting member 4*k* includes a supporting shaft and a spring so that the pressure promoting member 4*k* is rotatably attached to a part of a supporting body of the developing device 4. As a result, the cleaning blade 11*a* is in contact with the surface of the photosensitive drum 1 due to a pressing force produced by the pressure promoting member 4*k*.

The cleaning blade 11*a* fixed to the chassis 4*j* of the first developing unit 4 has some advantages: a simple structure, easy to reduce the size, and low cost because such units as a driving unit and a biasing unit are not necessary. However, since the cleaning blade 11*a* always in contact with the image carrier (photosensitive drum), the cleaning blade 11*a* is likely to be deformed and the pressure applied to the image carrier is likely to be reduced due to the permanent distortion of the cleaning blade 11*a*. Further, it is difficult to remove toner or any foreign matter such as paper powder remaining in a contacting part between the elastic cleaning blade 11*a* and the image carrier 1, which often causes abnormal images.

On the other hand, in the second developing unit 4, the movable cleaning blade 11*a* can be put in contact with and separated from the image carrier by an added contacting and separating mechanism for separating the cleaning blade 11*a* from the image carrier and a position controlling member for adjusting the position of the cleaning blade 11*a* with respect to the image carrier. This method is being employed in systems requiring long service life.

As described above, implementing such a movable cleaning blade or such a contacting and separating mechanism is useful to avoid damage to the edge of the cleaning blade caused by the residual toner or foreign matter. However, recently there has been a demand for reducing the size of the image forming apparatus. Unfortunately, it is difficult to achieve a good balance between the implementation and the demand because of cost increases with conventional technology. As a result, the implementation is tending to be neglected and long service lives of the cleaning blade and the photosensitive body are not being provided in many cases.

SUMMARY OF THE INVENTION

The present invention is made in light of the circumstances, and may provide a cleaning device, a process cartridge, and an image forming apparatus capable of reducing the size of the apparatus and prolonging the service life of the cleaning blade.

According to a first aspect of the present invention, there is provided a cleaning device installed in an image forming apparatus including an image carrier, a charging device for uniformly charging a surface of the image carrier, an exposing device for exposing the uniformly-charged surface of the image carrier to form an electrostatic image, a developing device for developing the formed electrostatic image with a developing agent so as to form a visible image on the image carrier, a transferring device for transferring the image on the image carrier onto a transferring member, and the cleaning device for removing the developing agent remaining on the image carrier after the visible image has passed through the transferring device, the cleaning device including a cleaning blade including an elastic blade, the elastic blade being fixed to a chassis of the cleaning device, and an edge of the elastic blade being in contact with the surface of the image carrier on a steady basis, a pressing member disposed near the downstream side of the image carrier with respect to the elastic blade and extending in the longitudinal direction of the elastic blade; and a driving mechanism for driving the pressing member so that the pressing member is in contact with and presses a downstream side surface of the elastic blade, wherein, when an image forming process is ended, the driving mechanism operates so that the pressing member presses the elastic blade in the upstream direction of the image carrier so as to separate the elastic blade from the surface of the image carrier for a while, and then, the driving mechanism operates to move the pressing member to be separated from the elastic blade so that the elastic blade is in contact with the surface of the image carrier.

According to a second aspect of the present invention, the pressing member is a rod-shaped member.

According to a third aspect of the present invention, the pressing member is a thin plate-shaped member.

According to a fourth aspect of the present invention, the cleaning device further includes a removing member having a sheet shape, disposed on the upstream side of the image carrier with respect to the cleaning blade, and in contact with the edge of the elastic blade when the elastic member is pressed by the pressing member to be separated from the image carrier.

According to a fifth aspect of the present invention, the removing member is made of urethane resin.

According to a sixth aspect of the present invention, the cleaning device further includes a brush roller disposed on the upstream side of the image carrier with respect to the cleaning blade so that the brush roller is in contact with the image carrier and the circumference of the brush roller is in contact with the edge of the elastic blade when the elastic blade separates from the image carrier.

According to a seventh aspect of the present invention, just before the elastic blade separates from the image carrier, the image carrier rotates in the direction opposite to the normal direction for forming an image.

According to an eighth aspect of the present invention, there is provide a process cartridge including a charging device for uniformly charging a surface of an image carrier, a developing device for developing an electrostatic image formed on the image carrier with a developing agent so as to form a visible image on the image carrier; and a cleaning device as described above.

According to a ninth aspect of the present invention, there is provided an image forming apparatus including the above cleaning device.

According to a tenth aspect of the present invention, there is provided an image forming apparatus including the above process cartridge.

According to an embodiment of the present invention, there is provided a pressing member having a simple structure for deforming an elastic blade to separate the elastic blade from the surface of an image carrier and making contact between the elastic blade and the surface of an image carrier again. Due to the impact when the elastic blade is in contact with the surface of the image carrier, remaining toner (developing agent) and foreign matter attached to the edge of the elastic blade are blown off, thereby securing stable toner cleaning performance for a long period of time and avoiding the formation of an abnormal image.

BRIEF DESCRIPTION OF THE DRAWINGS

Other objects, features, and advantages of the present invention will become more apparent from the following descriptions when read in conjunction with the accompanying drawings, in which.

DETAILED DESCRIPTION OF THE PREFERRED EMBODIMENTS

Exemplary embodiments of the present invention are described with reference to the accompanying drawings.

Embodiment 1

Figure 1:
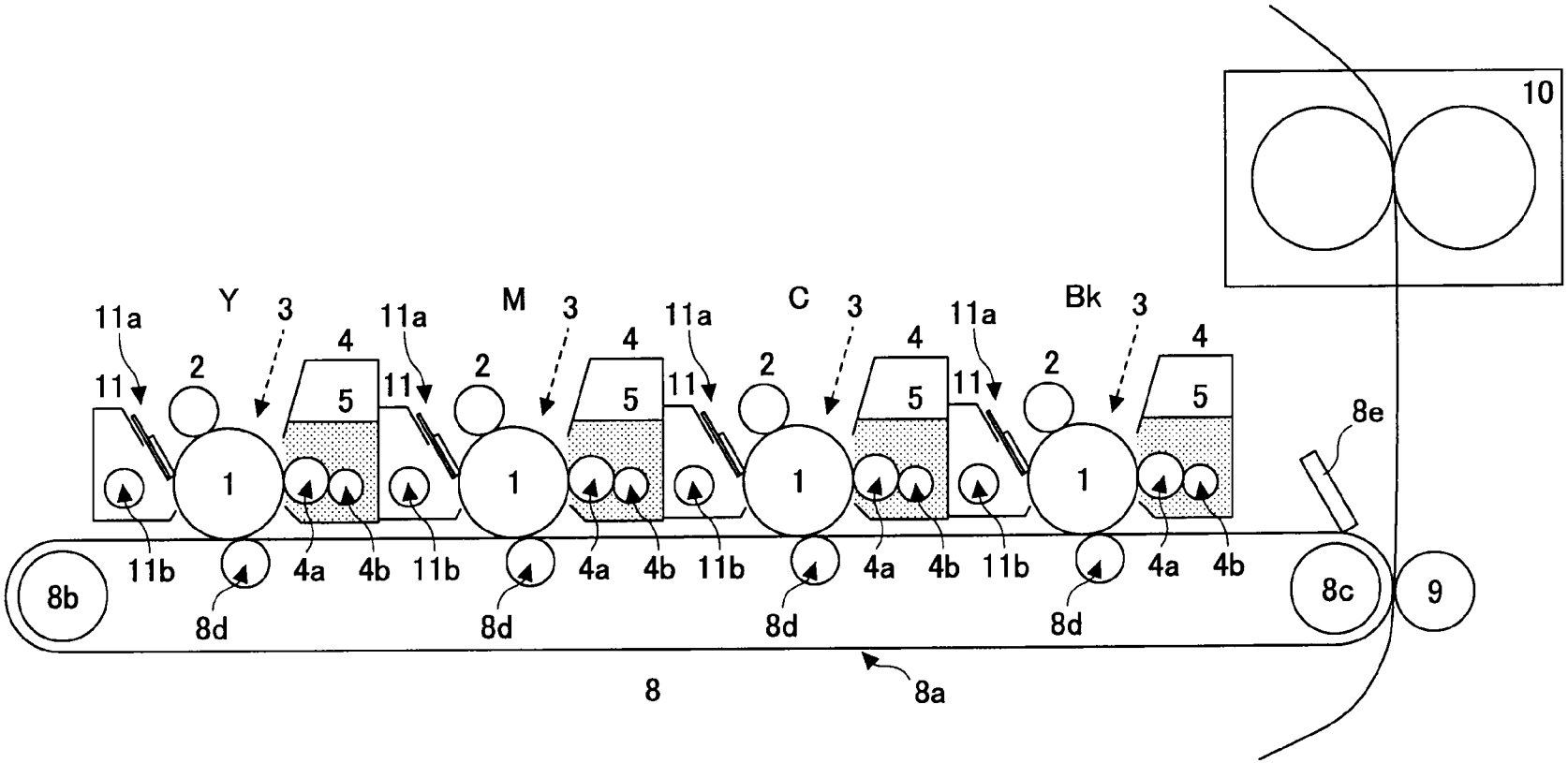
FIG. 1 is a cut-open view schematically showing the image forming apparatus according to an embodiment of the present invention.

In the following, an image forming apparatus according to an embodiment of the present invention is described. FIG. 1 is a cut-open view schematically showing the image forming apparatus according to an embodiment of the present invention. The image forming apparatus according to an embodiment of the present invention is a full-color image forming apparatus employing the electrophotographic method. The image information apparatus includes developing devices 4 for developing yellow (Y), magenta (M), cyan (C), and black (Bk) images, respectively. In the vicinity of the each developing device, there is provided a photosensitive drum 1 having an optical conductive layer made of organic material such as OPC and serving as an image carrier capable of rotating in both normal and opposite directions. In the vicinity of the photosensitive drum 1, along the normal rotating direction, there are provided a charging roller 2, an exposing device 3, a developing device 4, and a cleaning device 11 to perform an image forming process. Those devices for each color are arranged in parallel to constitute a process cartridge.

The charging roller 2 is a conductive roller in contact with the photosensitive drum so as to rotate in accordance with the rotation of the photosensitive drum 1. A direct current voltage or a superimposed voltage including a direct current voltage and an alternative current voltage from a high voltage source is applied to the photosensitive drum 1 through the charging roller 2, so that the optical conductive layer is uniformly charged.

Then, an electrostatic latent image is formed on the photosensitive drum 1 by the exposing device 3. The electrostatic latent image on the photosensitive drum 1 is developed by the developing device 4. As the developing device 4, a contact-type one-component developing device is used. In the contact-type one-component developing device, a developing roller 4*a* made of, for example, an elastic body is in contact with the photosensitive drum 1, and toner 5 stored in a hopper is supplied and fed to the developing roller 4*a* through a supplying roller 4*b*. Then, a thin toner layer is formed on the developing roller with the supplied and fed toner by using a regulating blade in contact with the developing roller. When the thin toner layer is in contact with the electrostatic latent image, the electrostatic latent image is formed (visualized).

The visualized images formed on the photosensitive drum 1 by the corresponding developing devices 4 of four colors are sequentially transferred and superposed onto a transferring belt 8*a* in a primary transferring section, so that a full color image is formed on the transferring belt 8*a*.

As shown in FIG. 1, a transferring device 8 includes a driving roller 8*b*, a transferring belt 8*a* stretched between a pair of rollers including the driving roller 8*b*, transferring bias rollers 8*d* disposed inside the transferring belt 8*a* and facing the photosensitive drums 1 of each color, a contacting and separating mechanism (not shown) for causing the transferring belt 8*a* and the transferring bias rollers 8*d* to contact the photosensitive drums 1, and a transferring belt cleaning device (not shown) having an elastic blade 8*e*.

In the transferring device 8, the visualized image on each of the photosensitive drums 1 is transferred onto the transferring belt 8*a* by applying a bias voltage from a high voltage source through the transferring bias roller 8*d*. Then, a transferring sheet fed from a sheet supplying device at resist timing set by a resist roller is fed to a roller 8*c* in the transferring device 8 so that the transferring sheet is pressed by a secondary transferring roller 9. Then, the full color image formed on the transferring belt 8*a* is transferred onto the transferring sheet by applying a bias voltage from a high voltage source to the secondary transferring roller 9.

The transferring sheet onto which the full color image is transferred by the transferring device 8 is fed to a fixing device 10 and is ejected onto an ejection tray (not shown). In each developing device 4, after a visualized image is formed on the photosensitive drum 1, the toner remaining on the photosensitive drum 1 as transfer remaining toner not transferred in the primary transferring section is conveyed in accordance with the rotation of the photosensitive drum 1 and is collected in the cleaning device 11.

Figure 2:
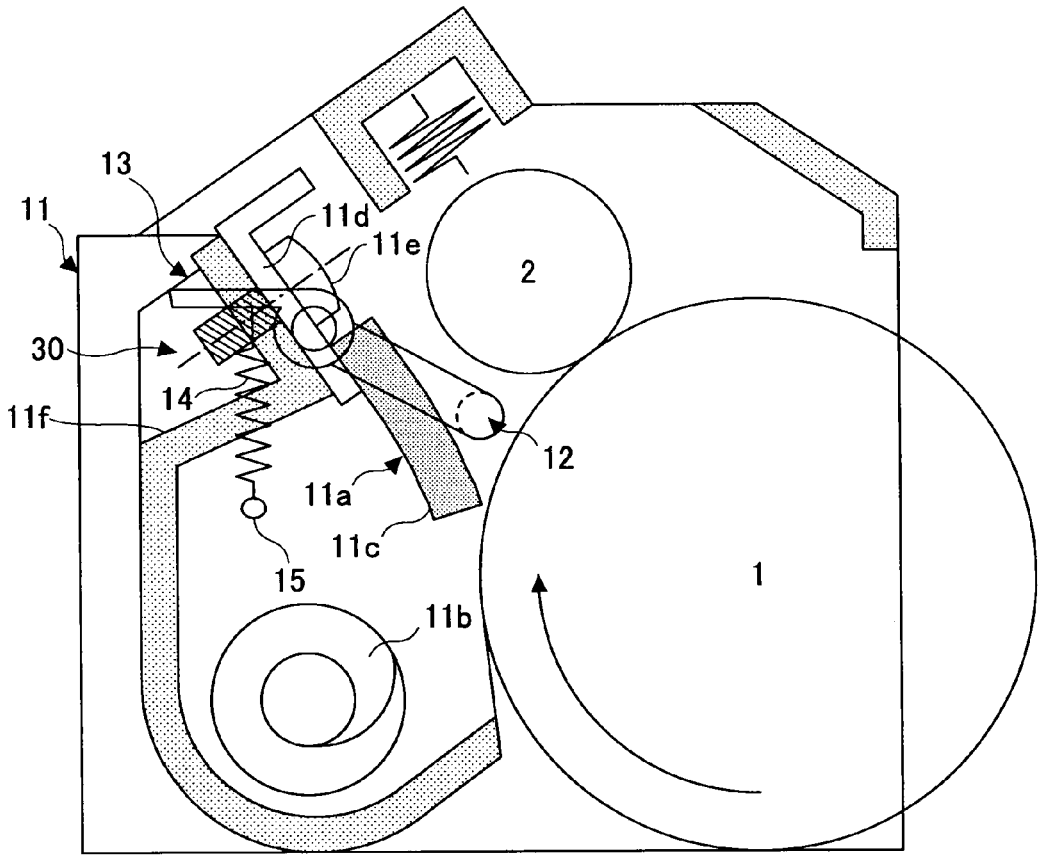
FIG. 2 is a cut-open view schematically showing a configuration of the cleaning device according to a first embodiment of the present invention.

FIG. 2 is a cut-open view schematically showing a configuration of the cleaning device 11. As shown in FIG. 2, the cleaning device 11 includes a cleaning blade 11*a*, a conveying screw 11*b*, and a screw 11*e*. The cleaning blade 11*a* includes an elastic blade 11*c* having a rectangular shape and a supporting member 11*d* supporting the elastic blade 11*c*. The supporting member 11*d* of the cleaning blade 11*a* is fixed to a prescribed position in the chassis 11*f* of the cleaning device 11 with the screw 11*e*, so that the edge of the elastic blade 11*c* is in contact with the photosensitive drum 1 when the cleaning device 11 and the photosensitive drum 1 are in contact with each other. The conveying screw 11*b* conveys the remaining toner collected by the cleaning device 11 to a toner collecting bottle (not shown).

In this example shown in FIG. 2, there is provided a pressing member 12 manufactured by bending a round-rod member and disposed in the vicinity of a surface of the elastic blade 11*c* on a downstream side of the photosensitive drum 1. The pressing member 12 is driven by a driving mechanism 30. When an image forming process ends, the pressing member 12 presses the elastic blade 11*c* in the upstream direction of the photosensitive drum 1, so that the elastic blade 11*c* separates from the surface of the photosensitive drum 1. Then, after a prescribed time period, the pressing member 12 is moved in the direction so that the pressing member 12 separates from the elastic blade 11*c*. As a result, the elastic blade 11 is in contact with the photosensitive drum 1 again.

Figure 3:
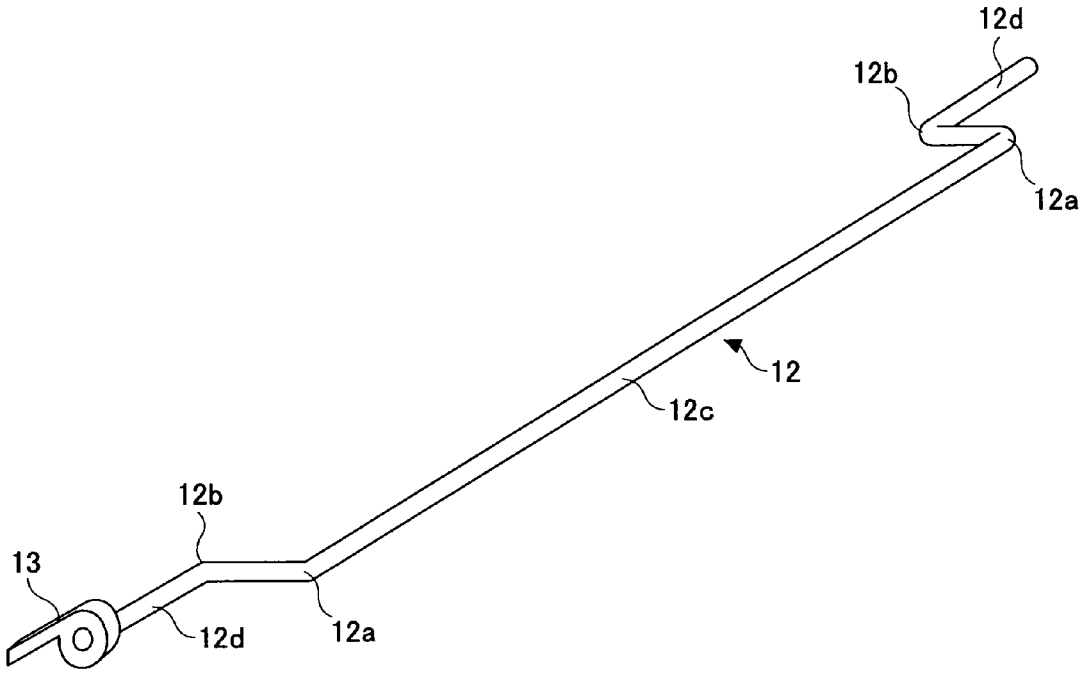
FIG. 3 is a perspective view showing the pressing member shown in FIG. 2.
Figure 4:
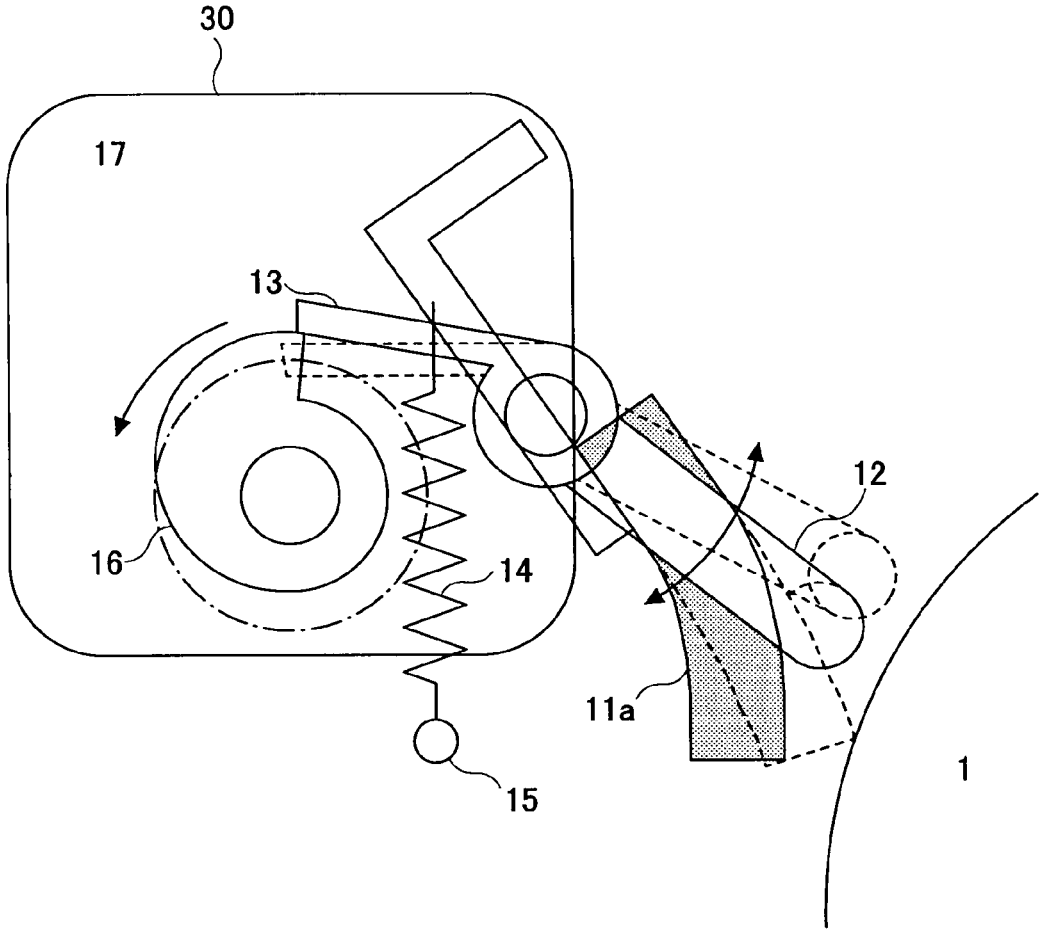
FIG. 4 is a cut-open view schematically showing the pressing member and the driving mechanism in FIG. 2.

FIG. 3 is a perspective view showing the pressing member 11. FIG. 4 is a cut-open view schematically showing the pressing member 12 and the driving mechanism 30. As shown in FIG. 3, the pressing member 12 extends in the direction parallel to the longitudinal direction of the elastic blade 11*c*. The pressing member 12 has a bent part 12*a* and a bent part 12*b* disposed beyond each end of the elastic blade 11*c* across an extended part 12*c* and bent with a prescribed crank angle. Further, at least one of the ends 12*d* of the pressing member 12 is rotatably supported by a supporting part of the chassis 11*f* of the cleaning device 11 and is extended through the chassis 11*f* of the cleaning device 11 to the outside where an arm member 13 is fixed to the end 12*d*.

The pressing member 12 is driven by a driving mechanism 30. The driving mechanism 30 includes the arm member 13 fixed to the end 12*d* of the pressing member 12 and a spring 14 interposed between the arm member 13 and a fixing part 15 on the chassis 11*f* of the cleaning device 11. The arm member 13 is biased toward the fixing part 15 by the spring 14. Further, in the cleaning device 11, as shown in FIG. 4, there is provided a cam 16 capable of being rotated by a driving motor 17 and in contact with the arm member 13 so as to drive the arm member 13 to oscillate in the up and down direction.

To drive the arm member 13 so that the end of the arm member 13 oscillates in the up and down direction, the outer circumferential contour shape of the cam 16 is formed in a manner so that the radius of the cam increases from the minimum radius to the maximum radius as the cam rotates 360 degrees and suddenly decreases from the maximum radium to the minimum radius, as shown in FIG. 4. Because of the contour shape of the cam 16, when the cam 16 is rotated by the driving motor 17 and the distance between the center of the cam 16 and the arm member 13 equals an effective radius (refers to the shortest distance between the center of the cam 16 and the arm member 13) of the cam 16, the cam 16 is in contact with the arm member 13 and starts rotating the arm member 13 as the cam 16 rotates.

As shown in FIG. 4, as the arm member 13 rotates, the pressing member 12 also rotates and the extended part 12*c* of the pressing member 12 is in contact with and presses the surface of the elastic blade 11*c* so that the elastic blade 11*c* elastically deforms in the upstream direction of the photosensitive drum 1. By doing this, the edge of the elastic blade 11*c* is separated from the surface of the photosensitive drum 1. When the effective radius of the cam 16 equals the maximum radius of the cam 16, the distance between the edge of the elastic blade 11*c* and the surface of the photosensitive drum 1 is also maximized. Then, the cam 16 further rotates, the effective radius suddenly decreases and accordingly, the pressing force of the arm member 13 is also suddenly released. As a result, the arm member 13 is pulled toward the fixing part 15 by the spring 14; the pressing member 12 separates from the surface of the elastic blade 11*c*; and the elastic blade 11*c* is in contact with the surface of the photosensitive drum 1 again. Due to the impact when the elastic blade 11*c* makes contact with the surface of the photosensitive drum 1, remaining toner and foreign matter attached to the edge of the elastic blade 11*c* are blown off and collected by the conveying screw 11*b* provided in the chassis 11*f* of the cleaning device 11.

The driving mechanism 30 is controlled by a driving controlling device (not shown). When an image forming process is ended, the driving mechanism 30 is driven by the driving controlling device so that the pressing member 12 presses the elastic blade 11*c* to the upstream side of the photosensitive drum 1 to separate the elastic blade 11*c* from the surface of the photosensitive drum 1. After a prescribed time period, the pressing member 12 is driven and moved in the downstream direction of the photosensitive drum 1 so that the pressing member 12 separates from the elastic blade 11*c*. As a result, the elastic blade 11*c* is in contact with the surface of the photosensitive drum 1 again.

Figure 5:
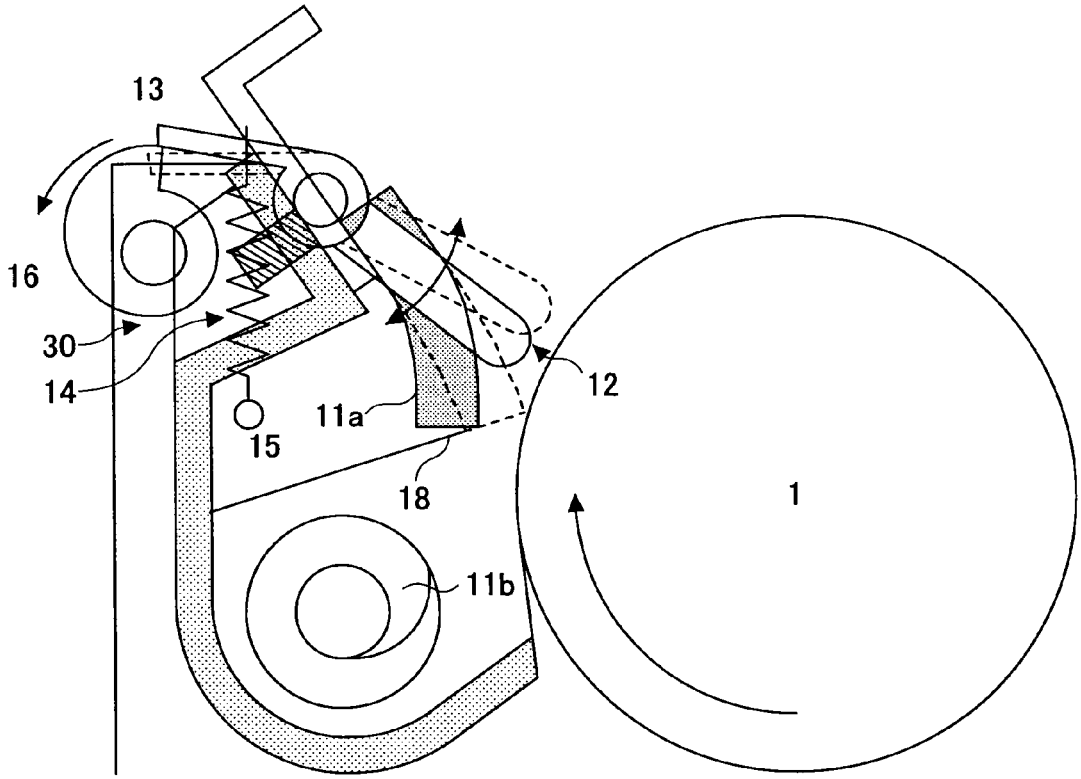
FIG. 5 is a schematic diagram showing a cleaning device according to a modified first embodiment of the present invention.

Next, a modified embodiment of the present invention is described. FIG. 5 is a schematic diagram showing a cleaning device according to a modified first embodiment of the present invention. In this modified embodiment, there is provided a removing section 18 made of urethane resin sheet material. The removing section 18 is disposed on the upstream side of the photosensitive drum 1 with respect to the cleaning blade 11*a*, so that the removing section 18 is in contact with the edge of the elastic blade 11*c* when the elastic blade 11*c* is pressed by the pressing member 12 and separated from the surface of the photosensitive drum 1.

According to this modified embodiment of the present invention, when the elastic blade 11*c* of the cleaning blade 11*a* is deformed by the pressing member 12, the edge of the elastic blade 11*c* is in contact with the edge of the removing section 18 so that the remaining toner and foreign matter attached to the edge of the elastic blade 11*c* can be effectively removed.

Figure 6:
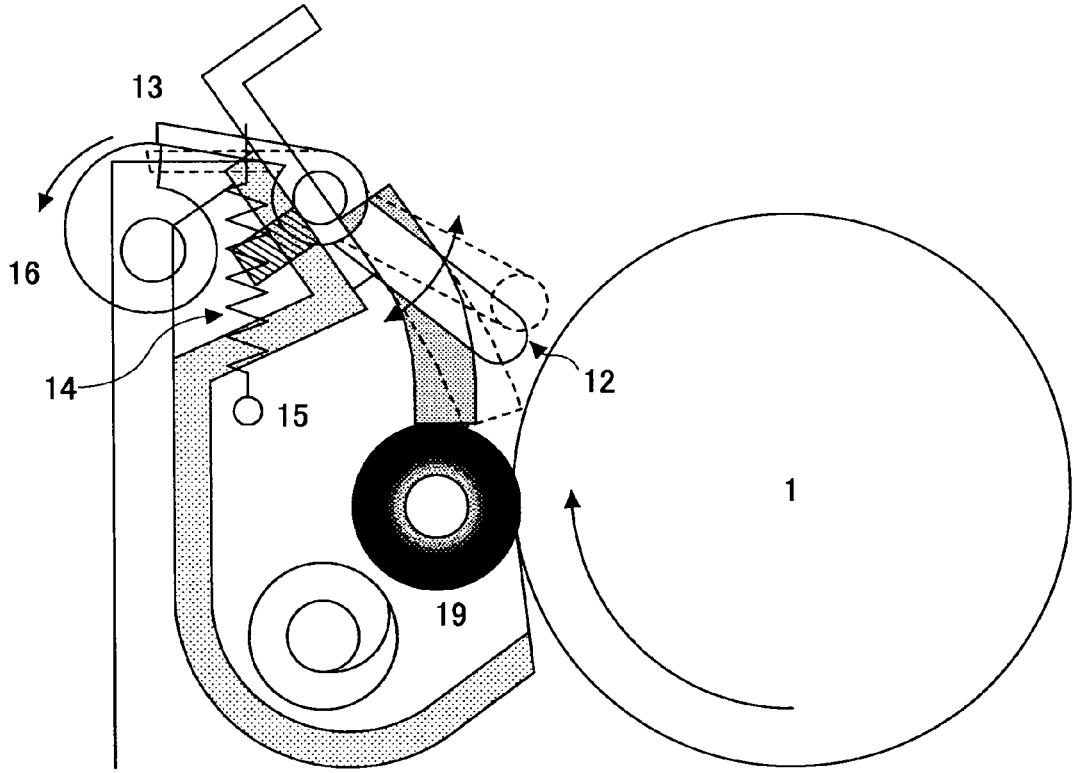
FIG. 6 is a schematic diagram showing a cleaning device according to another modified first embodiment of the present invention.

FIG. 6 is a schematic diagram showing a cleaning device according to another modified first embodiment of the present invention. In this modified embodiment, there is provided a brush roller 19 disposed on the upstream side of the photosensitive drum 1 with respect to the cleaning blade 11*a*, so that the brush roller 19 is in contact with the photosensitive drum 1 and the circumference of the brush roller 19 is in contact with the edge of the elastic blade 11*c* when the elastic blade 11*c* is pressed by the pressing member 12 and separated from the surface of the photosensitive drum 1.

According to this modified embodiment of the present invention, when the elastic blade 11*c* is separated from the photosensitive drum 1, the edge of the elastic blade 11*c* is in contact with the circumference of the brush roller 19, so that the remaining toner and foreign matter attached to the edge of the elastic blade 11*c* can be effectively removed.

Further, it is possible to arrange that just before the elastic blade 11*c* separates from the photosensitive drum 1 or while the elastic blade 11*c* separates from the photosensitive drum 1, the photosensitive drum 1 rotates by a prescribed angular distance in the direction opposite to the normal direction for forming an image. As a result of this arrangement, when the elastic blade 11*c* is in contact with the photosensitive drum 1 again, the elastic blade 11*c* is in contact with the downstream side of the photosensitive drum 1 by the prescribed angular distance. Therefore, it becomes possible to remove the toner remaining on the surface of the photosensitive drum 1 when the cleaning blade 11*a* is separated from photosensitive drum 1, thereby avoiding the contamination of the charging roller 2 disposed on the downstream side with respect to the cleaning blade 11*a*.

Embodiment 2

Next, an image forming apparatus according to a second embodiment of the present invention is described with reference to FIGS. 7 through 10. It is assumed that a configuration of the image forming apparatus according to the second embodiment of the present invention is the same as that of the image forming apparatus according to the first embodiment of the present invention unless otherwise described.

Figure 7:
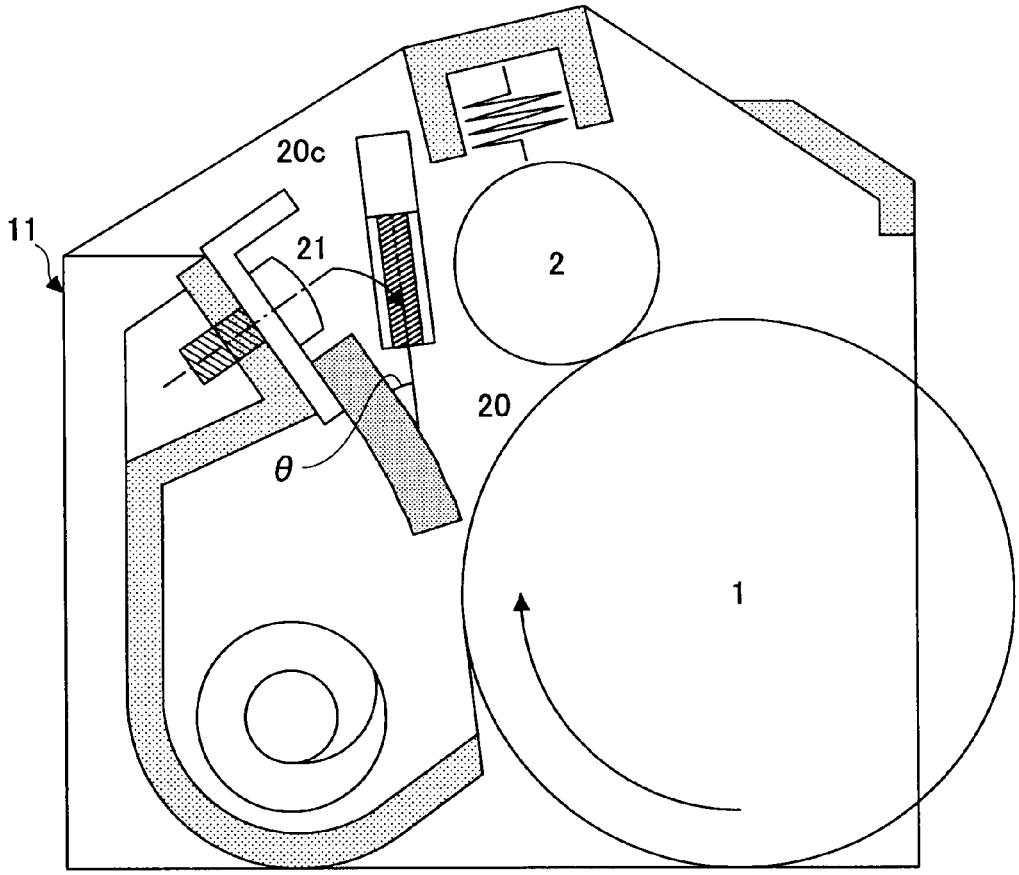
FIG. 7 is a cut-open view schematically showing a cleaning device according to a second embodiment of the present invention.
Figure 8:
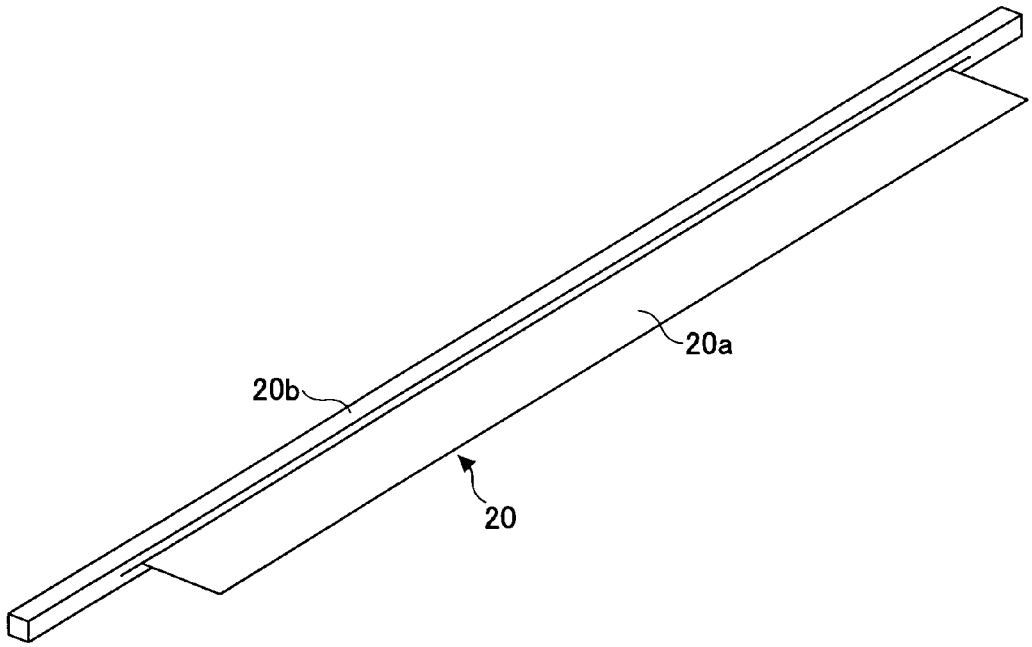
FIG. 8 is a perspective view showing a pressing member pressing the cleaning blade in the cleaning device.
Figure 9:
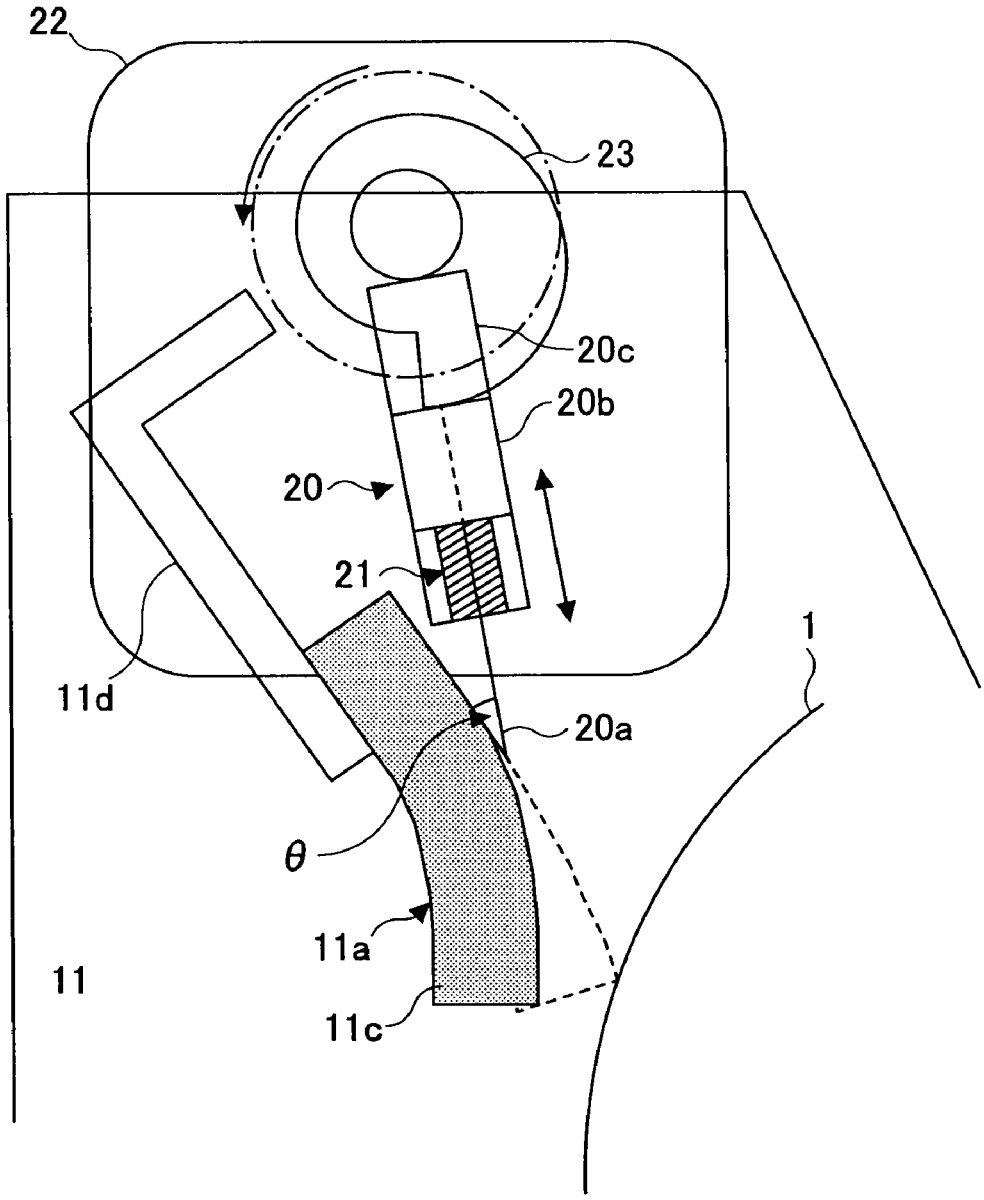
FIG. 9 is a cut-open view schematically showing an operation of the pressing member in the cleaning device.
Figure 10:
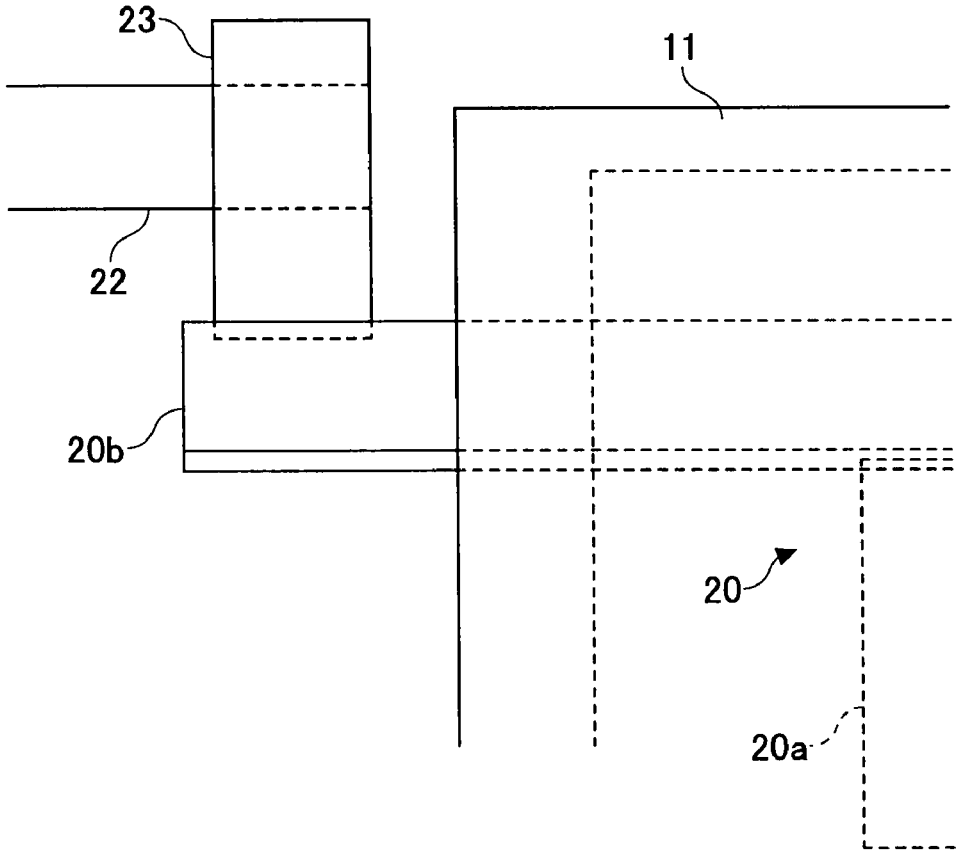
FIG. 10 is a drawing showing a mechanism for driving the pressing member.

FIG. 7 is a cut-open view schematically showing a cleaning device 11 according to the second embodiment of the present invention. FIG. 8 shows a configuration of the pressing member 20 shown in FIG. 7 pressing the cleaning blade 11*a* in the cleaning device 11. FIG. 9 is a cut-open view schematically showing an operation of the pressing member 20 in the cleaning device 11. FIG. 10 is a drawing showing a mechanism for driving the pressing member 20. It should be noted that the cleaning device 11 according to this second embodiment of the present invention is similar to the cleaning device 11 according to the first embodiment of the present invention. Namely, the cleaning device 11 according to the second embodiment of the present invention includes a cleaning blade 11*a*, a conveying screw 11*b*, and a screw 11*e*. The cleaning blade 11*a* includes an elastic blade 11*c* having a rectangular shape and a supporting member 11*d* supporting the elastic blade 11*c*. The supporting member 11*d* of the cleaning blade 11*a* is fixed to a prescribed position in the chassis 11*f* of the cleaning device 11 with the screw 11*e*, so that the edge of the elastic blade 11*c* is in contact with the photosensitive drum 1 when the cleaning device 11 and the photosensitive drum 1 are in contact with each other. The conveying screw 11*b* conveys the remaining toner collected by the cleaning device 11 to a toner collecting bottle (not shown).

The configuration of the pressing member 20 according to this second embodiment of the present invention is different from that of the first embodiment of the present invention. More specifically, as shown in FIG. 8, the pressing member 20 includes a contacting plate member 20*a* and a holding member 20*b*. The contacting plate member 20*a* has a thin plate shape and is in contact with the elastic blade 11*c*. The holding member 20*b* has a rod shape and supports the contacting plate member 20*a*. Further, as shown in FIG. 9, the pressing member 20 extends in the direction parallel to the longitudinal direction of the elastic blade 11*c*, and is disposed so that the edge of the contacting plate member 20*a* is in contact with the surface of the elastic blade 11*c* at a prescribed angle "θ".

In this embodiment, both ends of the holding member 20*b* of the pressing member 20 are supported by supporting parts 20*c* of cleaning cartridge side plates and are in contact with the cam 23 so that the prescribed angel "θ" is substantially constant as the pressing member 20 changes its position according to the rotation of the cam 23. Further, the holding member 20*b* is biased to the side of the cam 23 by a compression spring 21.

The cam 23 has the same shape as that of the cam 16 and is driven by a driving motor 22. As the cam 23 rotates, the pressing member 20 moves along the contour of the cam 23 and the edge of the contacting plate member 20*a* is in contact with the photosensitive drum 1 side of the elastic blade 11*c* at the prescribed angle "θ". As the pressing member 20 moves, the pressing member 20 deforms the elastic blade 11*c* so that the elastic blade 11*c* separates from the photosensitive drum 1. As the cam 23 further rotates, the pressing member 20 moves into a position where the effective radius of the cam 23 is minimum. Then, the holding member 20*b* is biased by the compression spring 21, and the contacting plate member 20*a* separates from the elastic blade 11*c*. As a result, the elastic blade 11*c* is in contact with the photosensitive drum 1 again.

When an image forming process ends and the stopped status of the photosensitive drum 1 is detected, as shown in FIG. 10, a controlling unit (not shown) drives and rotates the driving motor 22 to rotate the cam 23. As a result, the cam 23 moves the holding member 20*b* so that the contacting plate member 20*a* is moved in the direction of the elastic blade 11*c*.

As the cam 23 rotates, the outer circumference of the cam 23 is in contact with the holding member 20*b*. Then, the holding member 20*b* is pressed in the direction of the photosensitive drum 1, and the contacting plate member 20*a* is in contact with the elastic blade 11*c* at a prescribed angle "θ". Then, the elastic blade 11*c* is elastically deformed and separates from the surface of the photosensitive drum 1. When the holding member 20*b* moves and is in contact with the cam 23 at a position where the effective radius of the cam 23 is maximum, the separation distance between the elastic blade 11*c* and the surface of the photosensitive drum 1 is maximized.

As the cam 23 further rotates, the effective radius suddenly decreases. Then, the holding member 20*b* separates from the cam 23, and the holding member 20*b* is moved by the compression spring 21 into a position where the holding member 20*b* does not deform the elastic blade 11*c*. Then, the edge of the elastic blade 11*c* is in contact with the surface of the photosensitive drum 1 due to the restoration force of the elastic blade 11*c*. Due to the impact when the elastic blade 11*c* regains contact with the surface of the photosensitive drum 1, remaining toner and foreign matter attached to the edge of the elastic blade 11*c* are blown off and collected by the conveying screw 11*b* provided in the chassis 11*f* of the cleaning device 11.

Figure 11:
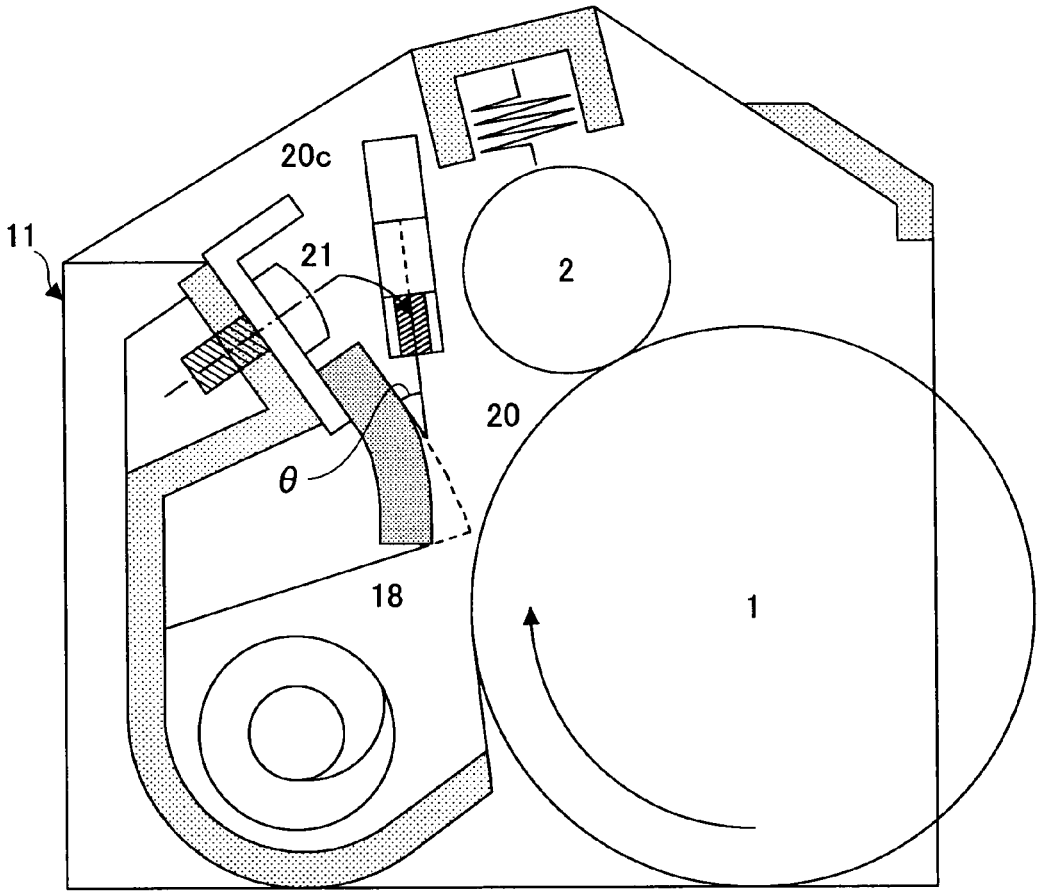
FIG. 11 is a cut-open view schematically showing a cleaning device according to a modified second embodiment of the present invention.

Next, a modified second embodiment of the present invention is described. FIG. 11 is a cut-open view schematically showing a cleaning device 11 according to the modified second embodiment of the present invention. In this modified embodiment, there is provided a removing section 18 made of urethane resin sheet material. The removing section 18 is disposed on the upstream side of the photosensitive drum 1 with respect to the cleaning blade 11*a*, so that the removing section 18 is in contact with the edge of the elastic blade 11*c* when the elastic blade 11*c* is pressed by the pressing member 12 and separated from the surface of the photosensitive drum 1.

According to this modified embodiment of the present invention, when the elastic blade 11*c* of the cleaning blade 11*a* is deformed by the pressing member 20, the edge of the elastic blade 11*c* is in contact with the edge of the removing section 18 so that the remaining toner and foreign matter attached to the edge of the elastic blade 11*c* can be effectively removed.

Figure 12:
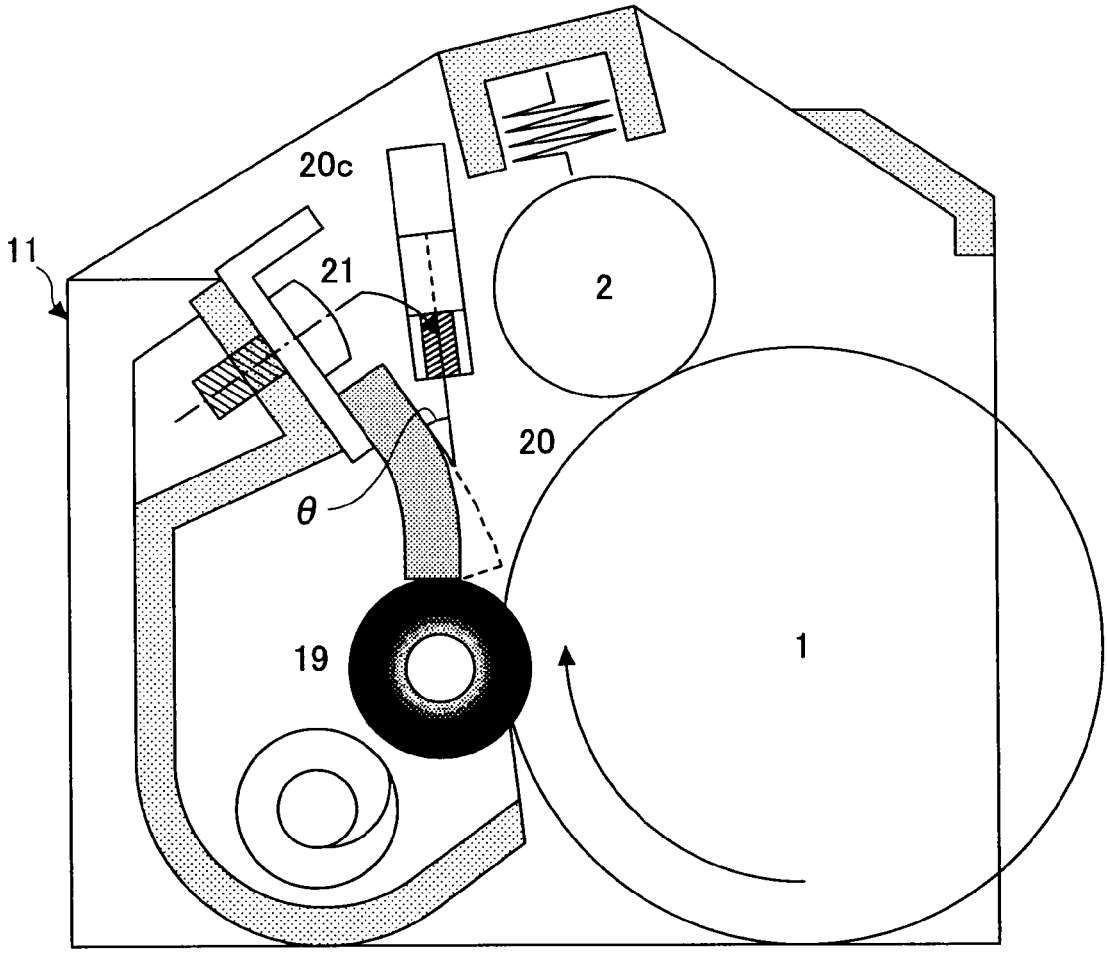
FIG. 12 is a cut-open view schematically showing a cleaning device according to another modified second embodiment of the present invention.
Figure 13:
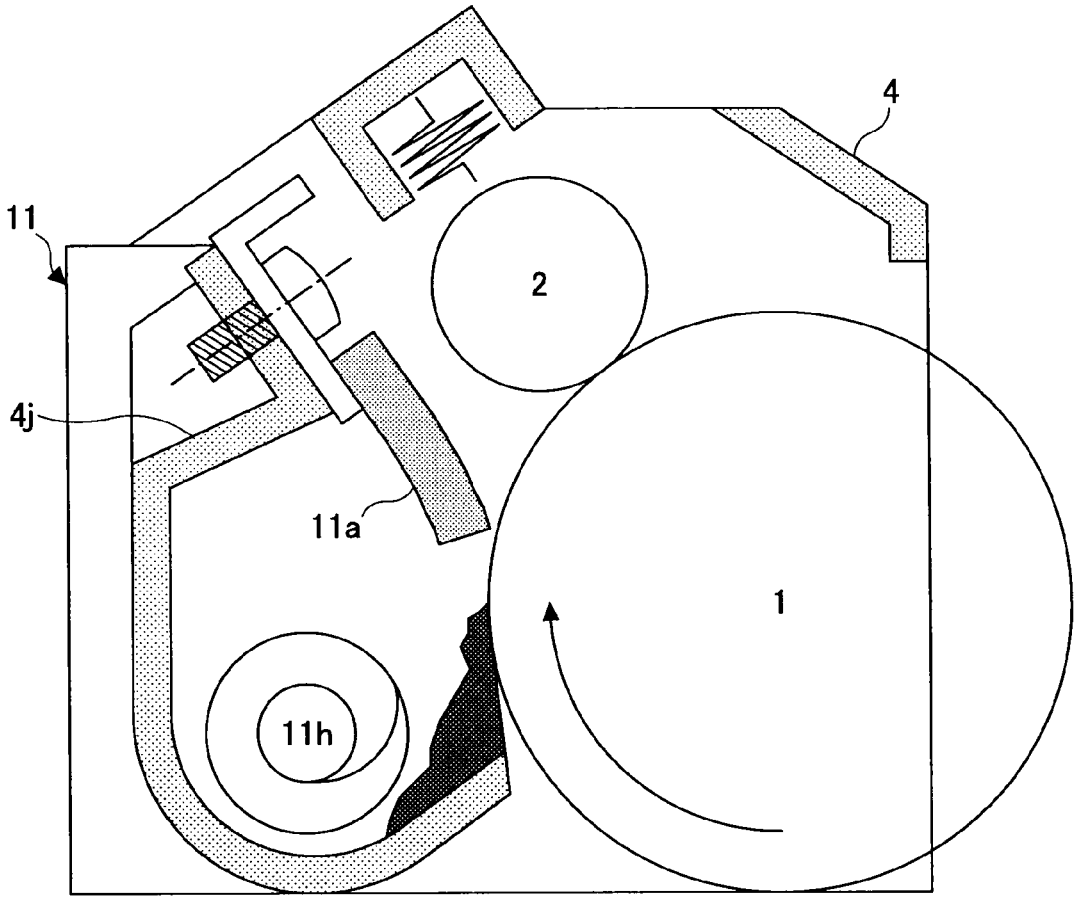
FIG.13 PRIOR ART
FIG. 13 is a cut-open view schematically showing a first type of a conventional developing unit.
Figure 14:
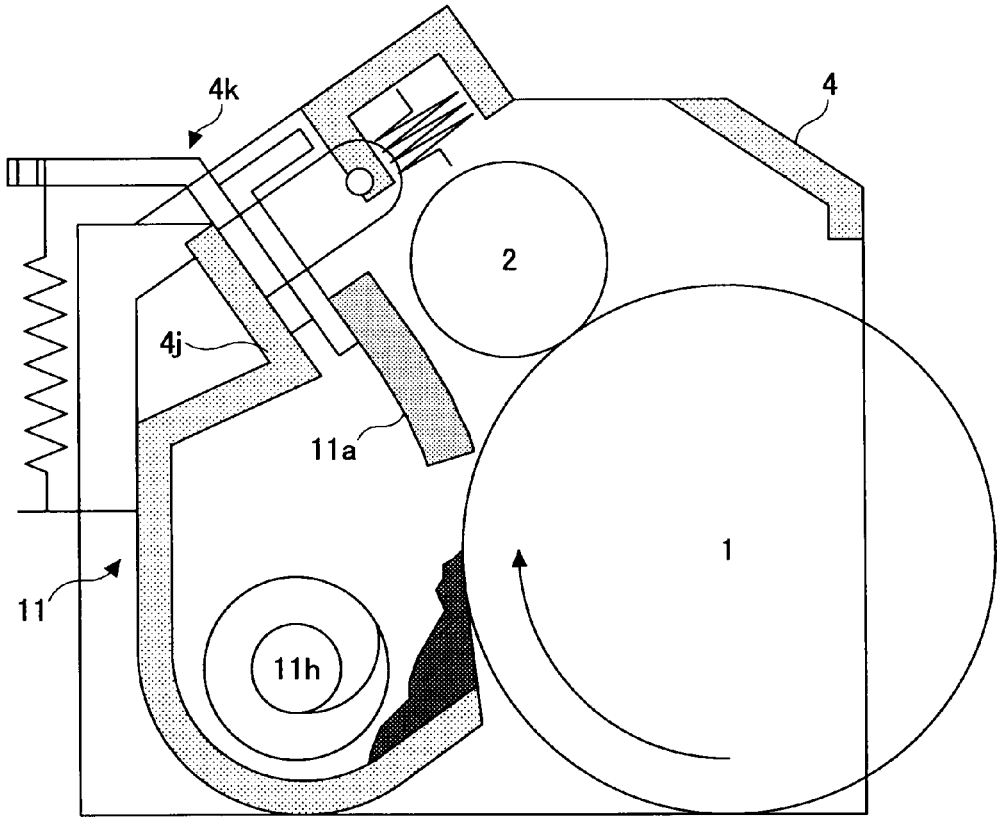
FIG.14 PRIOR ART
FIG. 14 is a cut-open view schematically showing a second type of a conventional developing unit.

FIG. 12 is a cut-open view schematically showing a cleaning device 11 according to another modified second embodiment of the present invention. In this modified embodiment, there is provided a brush roller 19 disposed on the upstream side of the photosensitive drum 1 with respect to the cleaning blade 11*a*, so that the brush roller 19 is in contact with the photosensitive drum 1 and the circumference of the brush roller 19 is in contact with the edge of the elastic blade 11*c* when the elastic blade 11*c* is pressed by the pressing member 20 and separated from the surface of the photosensitive drum 1.

According to this modified embodiment of the present invention, when the elastic blade 11*c* is separated from the photosensitive drum 1, the edge of the elastic blade 11*c* is in contact with the circumference of the brush roller 19, so that the remaining toner and foreign matter attached to the edge of the elastic blade 11*c* can be effectively removed.

Further, it is possible to arrange that just before the elastic blade 11*c* separates from the photosensitive drum 1 or while the elastic blade 11*c* separates from the photosensitive drum 1, the photosensitive drum 1 rotate by a prescribed angular distance in the direction opposite to the normal direction for forming an image. As a result of this arrangement, when the elastic blade 11*c* is in contact with the photosensitive drum 1 again, the elastic blade 11*c* is in contact with the downstream side of the photosensitive drum 1 by the prescribed angular distance. Therefore, it becomes possible to remove the toner remaining on the surface of the photosensitive drum 1 when the cleaning blade 11*a* is separated from photosensitive drum 1, thereby avoiding the contamination of the charging roller 2 disposed on the downstream side with respect to the cleaning blade 11*a*.

As described above, in a cleaning device according to an embodiment of the present invention, a simple contacting and separating mechanism is provided so as to control the cleaning blade fixed to the chassis of the cleaning device. As a result, it becomes possible to provide a compact cleaning device and to obtain high quality images for a long time period.

Further, according to an embodiment of the present invention, there is provided a removing section made of urethane resin sheet material. The removing section is disposed on the upstream side of the photosensitive drum with respect to the cleaning blade, so that the removing section is in contact with the edge of the elastic blade when the elastic blade is pressed by the pressing member and separated from the surface of the photosensitive drum. Because of this configuration, when the elastic blade of the cleaning blade is deformed by the pressing member, the edge of the elastic blade is in contact with the edge of the removing section so that the remaining toner and foreign matter attached to the edge of the elastic blade can be effectively removed, thereby providing a simple configuration and a stable toner cleaning performance.

Still further, according to an embodiment of the present invention, there is provided a brush roller disposed on the upstream side of the photosensitive drum with respect to the cleaning blade, so that the brush roller is in contact with the photosensitive drum and the circumference of the brush roller is in contact with the edge of the elastic blade when the elastic blade is pressed by the pressing member and separated from the surface of the photosensitive drum. When the elastic blade is separated from the photosensitive drum, the edge of the elastic blade is in contact with the circumference of the brush roller, so that the remaining toner and foreign matter attached to the edge of the elastic blade can be effectively removed, thereby providing a simple configuration and a stable cleaning performance.

Still further, according to an embodiment of the present invention, the image carrier is driven and rotated in the direction opposite to the normal direction for forming an image just before the elastic blade separates from the photosensitive drum. As a result of this arrangement, when the elastic blade is in contact with the photosensitive drum again, the toner remaining on the surface of the photosensitive drum can be collected by the cleaning blade without being skipped, thereby avoiding the contamination of the charging roller disposed on the downstream side with respect to the cleaning blade.

The present invention is not limited to the above embodiments, and variations and modifications may be made without departing from the scope of the present invention.

The present application is based on and claims the benefit of priority of Japanese Patent Application No. 2007-159714, filed on Jun. 18, 2007, the entire contents of which are hereby incorporated herein by reference.

What is claimed is:

1. A cleaning device for use with an image forming apparatus which includes:

an image carrier, a charging device for uniformly charging a surface of the image carrier, an exposing device for exposing the uniformly-charged surface of the image carrier to form an electrostatic image, a developing device for developing the formed electrostatic image with a developing agent so as to form a visible image on the image carrier, and a transferring device for transferring the image on the image carrier onto a transferring member, the cleaning device for removing the developing agent remaining on the image carrier after the visible image has passed through the transferring device, the cleaning device including:

a cleaning blade including an elastic blade which is supported by a supporting member, an edge of the elastic blade being in contact with the surface of the image carrier, and the supporting member being fixed to a prescribed position of the cleaning device;

a pressing member disposed in the vicinity of the downstream side of the image carrier with respect to the elastic blade and extending in the longitudinal direction of and directly contacting the elastic blade; and a driving mechanism for driving the pressing member so that the pressing member is in direct contact with and presses a downstream side surface of the elastic blade; wherein when an image forming process is ended, the driving mechanism operates so that the pressing member is in contact with and presses the elastic blade in the upstream direction of the image carrier so as to temporarily separate the elastic blade from the surface of the image carrier, and then, the driving mechanism operates to move the pressing member to be separated from the elastic blade so that the elastic blade returns to contact with the surface of the image carrier, and just before the elastic blade separates from the image carrier, the image carrier rotates for a prescribed angular distance in a direction opposite to a normal direction for forming an image so that when the elastic blade next contacts the image carrier, the elastic blade contacts the image carrier rotated by the prescribed angular distance.

2. The cleaning device according to claim 1, wherein the pressing member is a rod-shaped member.

3. The cleaning device according to claim 1, wherein the pressing member is a thin plate-shaped member.

4. The cleaning device according to claim 1, further comprising:

a removing member having a sheet shape, disposed on the upstream side of the image carrier with respect to the cleaning blade, and in contact with the edge of the elastic blade when the elastic blade is pressed by the pressing member to be separated from the image carrier.

5. The cleaning device according to claim 4, wherein the removing member is made of urethane resin.

6. The cleaning device according to claim 1, further comprising:

a brush roller disposed on the upstream side of the image carrier with respect to the cleaning blade so that the brush roller is in contact with the image carrier and the circumference of the brush roller is in contact with the edge of the elastic blade when the elastic blade separates from the image carrier.

7. A process cartridge comprising:

a charging device for uniformly charging a surface of an image carrier;

a developing device for developing an electrostatic image formed on the image carrier with a developing agent so as to form a visible image on the image carrier; and a cleaning device including a cleaning blade including an elastic blade which is supported by a supporting member, an edge of the elastic blade being in contact with the surface of the image carrier, and the supporting member being fixed to a prescribed position of the cleaning device;

a pressing member disposed in the vicinity of the downstream side of the image carrier with respect to the elastic blade and extending in the longitudinal direction of and directly contacting the elastic blade; and a driving mechanism for driving the pressing member so that the pressing member is in direct contact with and presses a downstream side surface of the elastic blade; wherein when an image forming process is ended, the driving mechanism operates so that the pressing member is in contact with and presses the elastic blade in the upstream direction of the image carrier so as to temporarily separate the elastic blade from the surface of the image carrier, and then, the driving mechanism operates to move the pressing member to be separated from the elastic blade so that the elastic blade returns to contact with the surface of the image carrier, and just before the elastic blade separates from the image carrier, the image carrier rotates for a prescribed angular distance in a direction opposite to a normal direction for forming an image so that when the elastic blade next contacts the image carrier, the elastic blade contacts the image carrier rotated by the prescribed angular distance.

8. The process cartridge according to claim 7, wherein the pressing member is a rod-shaped member.

9. The process cartridge according to claim 7, wherein the pressing member is a thin plate-shaped member.

10. The process cartridge according to claim 7, further comprising:

a removing member having a sheet shape, disposed on the upstream side of the image carrier with respect to the cleaning blade, and in contact with the edge of the elastic blade when the elastic blade is pressed by the pressing member to be separated from the image carrier.

11. The process cartridge according to claim 10, wherein the removing member is made of urethane resin.

12. The process cartridge according to claim 7, further comprising:

a brush roller disposed on the upstream side of the image carrier with respect to the cleaning blade so that the brush roller is in contact with the image carrier and the circumference of the brush roller is in contact with the edge of the elastic blade when the elastic blade separates from the image carrier.

13. A method of operating an image forming apparatus, comprising:

charging a surface of an image carrier;

exposing the surface of the image carrier to form an electrostatic image on the image carrier;

developing the electrostatic image which is on the image carrier to form a developed image;

transfer the developed image;

cleaning a surface of the image carrier using an elastic blade mounted to a supporting member which is fixed to a prescribed position;

rotating the image carrier for a prescribed angular distance in a direction opposite to a normal direction for forming an image while the elastic blade is in contact with the surface of the image carrier;

removing the elastic blade from contacting the surface of the image carrier, just after the rotating in the opposite direction, by a driving mechanism which drives a pressing member which is in direct contact with and presses a downstream side surface of the elastic blade;

contacting the blade to the surface of the image carrier after the image carrier has been rotated for the prescribed distance and after the blade has been removed from contacting the surface of the image carrier.

* * * * *